United States Patent [19]

Woertz

[11] 4,004,846

[45] Jan. 25, 1977

[54] ELECTRICAL TERMINAL

[75] Inventor: Hans Woertz, Basel, Switzerland

[73] Assignee: Oskar Woertz, Inhaber Hans Woertz, Basel, Switzerland

[22] Filed: Mar. 12, 1976

[21] Appl. No.: 666,477

[30] Foreign Application Priority Data

Mar. 25, 1975 Switzerland ..... 3759/75

[52] U.S. Cl. ..... 339/263 R

[51] Int. Cl.[2] ..... H01R 9/10

[58] Field of Search ..... 339/198, 263, 272

[56] References Cited

UNITED STATES PATENTS 3,539,977 11/1970 Woertz ..... 339/272 A

*Primary Examiner*—Joseph H. McGlynn

*Attorney, Agent, or Firm*—Werner W. Kleeman

[57] ABSTRACT

An electrical terminal having a housing formed of an insulating material and at least one clamping body having an opening for the reception of at least one conductor. At an open flat side of the insulating housing there is arranged at least one insert element formed of insulating material and forming a pocket receiving a blocking flap which prevents the introduction by mistake of a conductor externally of the clamping body into the insulating housing.

10 Claims, 6 Drawing Figures

ELECTRICAL TERMINAL

BACKGROUND OF THE INVENTION

The present invention relates to a new and improved construction of an electrical terminal.

The terminal of the invention is of the type comprising a substantially flat housing formed of an electrically insulating material, possessing recesses or openings which open in the direction of one flat side of the housing and containing at least one clamping device for fixedly clamping at least one electrical conductor which is to be connected at the terminal. The clamping device possesses a stationary contact element and a clamping body movable by means of a clamping screw in a direction perpendicular to the contact element. The clamping body is provided with an opening or cut-out for the reception of at least one conductor which is to be fixedly clamped and into which opening or cut-out there protrudes the contact element. At the conductor infeed mouth of the opening of the clamping body there is provided a blocking flap or tongue protruding away from the contact element and serving the purpose of preventing the mistaken introduction of a conductor externally of the clamping body into the insulating housing.

With state-of-the-art terminals of this type the blocking flap or tongue is either formed of one-piece with the clamping body or by a leg of a leaf spring inserted into the opening or cut-out of the clamping body. The free length of the blocking flap must be at least as large as the displacement path of the clamping body in the axial direction of the clamping screw. This requires that the blocking flap must be relatively long if the clamping device is constructed for fixedly clamping conductors of relatively large cross-section or for fixedly clamping at the same time a number of conductors. However, with the clamping device completely loose and with increasing length of the blocking flap there is present an increasing problem of the insulation against leakage currents and voltage breakdown between the blocking flap and the metallic support rails upon which there are normally mounted the terminals. In order to avoid having to resort to too great a structural height of the terminals for the above stated reasons, something which is undesired in many instances, previously solutions were proposed wherein an insulating hose was pushed over the blocking flap, the length of which hose must exceed by a certain amount that of the blocking flap. There was thereby attained an additional advantage that due to the presence of the insulating hose there was effectively avoided undesired insertion of a conductor laterally adjacent the blocking flap. The application of such insulating hoses to the blocking flap or tongue is, however, associated with considerable work and therefore increased costs for the fabrication of the terminals. Also there is present the danger that at a subsequent period of time the insulating hose due to improper handling, or because of ignorance of the significance thereof, is mistakingly again removed.

SUMMARY OF THE INVENTION

Hence, it is a primary object of the present invention to provide an improved construction of electrical terminal which is not associated with the aforementioned drawbacks and shortcomings of the prior art proposals.

Another and more specific object of the present invention aims at the provision of a terminal of the previously mentioned type which is constructed in such a manner that there is dispensed with the need for assembling an insulating hose upon the blocking flap or tongue, and moreover, there is realized a still better insulation against leakage currents and voltage breakdown between the blocking flap and metallic parts arranged externally of the terminal than such was previously possible when using an insulating hose.

Now in order to implement these and still further objects of the invention, which will become more readily apparent as the description proceeds, the terminal of this development is manifested by the features that at the open flat side of the insulating housing of the terminal there is arranged at least one insert element formed of insulating material, this insert element forming a pocket for receiving the blocking flap.

By virtue of the terminal construction as contemplated by the invention it is possible, following the assembly of the conventional components, to finally still mount in a simple manner the aforementioned insert element from the open flat side of the insulating housing, in order to thereby appreciably increase the insulation resistance of the terminal, without having to otherwise enlarge for this purpose the external geometric dimensions of the terminal. Conversely, it is also possible, in comparison to prior art constructional manifestations, with unaltered insulation resistance of the terminal and the same external dimensions thereof, to increase the reception capability of the opening of the clamping body so that a greater number of conductors can be fixedly clamped or there can be clamped conductors having larger cross-section.

In accordance with an advantageous embodiment of the terminal of this development the insert element can possess a strip-shaped projection or extension which extends in the direction of the clamping screw and which while extending along the open side of the insulating housing forms a boundary of the conductor infeed mouth of the opening or cut-out of the clamping body. Consequently, there is facilitated the proper insertion of the conductor into the opening of the clamping body. As a further aspect of this embodiment the part forming the pocket and the end portion of the projection facing away therefrom are each respectively anchored in the insulating housing against movement in or parallel to the lengthwise direction of the clamping screw. By virtue of this measure there is realized the advantage of increased mechanical stability of the terminal against unintentional bending of the insulating housing if during simultaneous clamping of a number of conductors the insulation thereof exerts a pressure upon the insulating housing which is open at one side, in the sense of widening the recess or cut-out thereof containing the clamping device.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
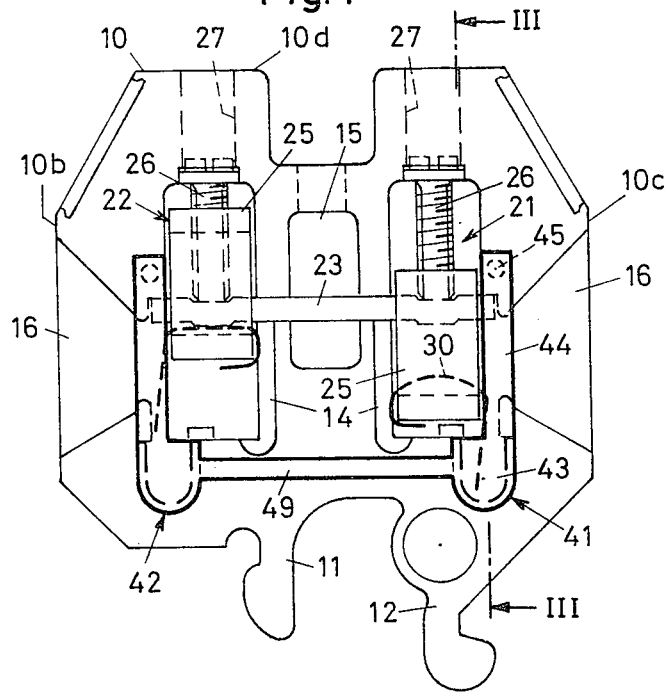
FIG. 1 illustrates an electrical terminal in side view, looking at the same from the open flat side of the insulating housing.
Figure 2:
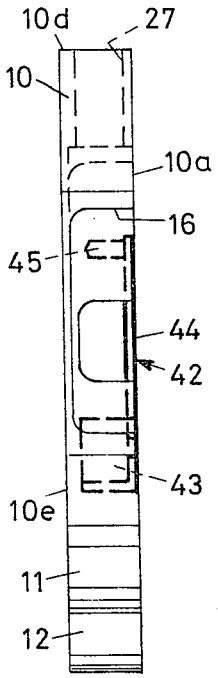
FIG. 2 is a view of the terminal from the left side of the showing of FIG. 1.
Figure 3:
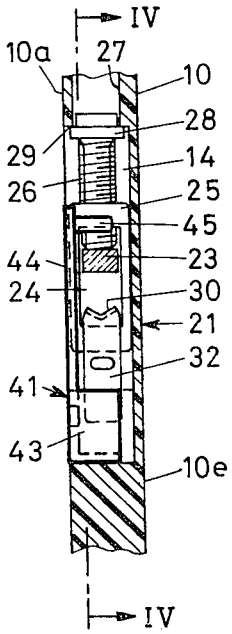
FIG. 3 is a partial cross-sectional view taken substantially along the line III—III of FIG. 1.

Referring now to FIGS. 1 to 3, the exemplary embodiment of terminal of the invention will be seen to comprise in conventional manner a flat housing 10 formed of any suitable electrically insulating material. The housing 10 is provided at its lower region with two slightly resilient feet 11 and 12 having holding claws for mounting the terminal upon a conventional and therefore not particularly illustrated support rail. The insulating housing 10 possesses a number of recesses or openings 14, 15 and 16 which are open in the direction of the one flat side 10*a* of the housing 10. The recesses 14 and 15 contain two clamping devices 21 and 22 which are of similar construction but arranged in mirror-image relationship with respect to one another. The recesses 16 form at the narrow oppositely facing end faces or sides 10*b* and 10*c* of the housing 10 funnel-like widening infeed mouths for the introduction of electrical conductors or leads which are to be fixedly clamped in the clamping devices 21 and 22. The clamping devices 21 and 22 possess a common, rod-shaped contact element 23 which is fixedly arranged in the insulating housing 10. Both of the end portions of the contact element 23 respectively extend through an opening or cut-out 24 of a clamping body 25. Each of both clamping bodies 25 possesses a threaded bore at the top in which there is inserted a clamping screw 26, the axial direction of which extends perpendicular to the contact element 23. The clamping screws 26 can each be actuated by means of a screwdriver or equivalent device which can be inserted through the bores 27 and brought into engagement with a slot of the relevent clamping screw 26 from the upper side 10*d* of the housing 10 which faces away from the feet 11 and 12. The end of each clamping screw 26 facing away from the actuation slot bears upon the contact element 23, thereby preventing a downward axial movement of the clamping screws. Conversely, a collar 28 provided at each clamping screw 26, in coaction with an impact shoulder 29 (FIG. 3) of the housing 10, secures the clamping screws against upward axial movement. Consequently, by actuating the clamping screw 26 the corresponding clamping body 25 of each clamping device 21 or 22, respectively, can be moved upwards or downwards in the axial lengthwise direction of the clamping screw 26.

Figure 4:
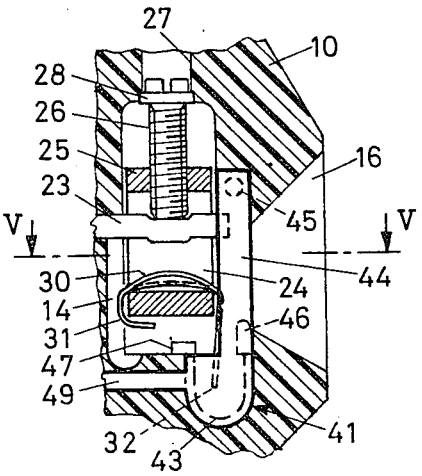
FIG. 4 illustrates details of the terminal, partially in side view analogous to the showing of FIG. 1 and partially in sectional view along the line IV—IV of FIG.3.

Beneath the contact element 23 there is inserted in the opening or cut-out 24 of each clamping body 25 a contact spring 30 formed of a leaf spring material, and which is secured in its position by a bent-over end portion 31 and a flexed end portion 32, as best seen by referring to FIG. 4. The flexed end portion 32 at the same time forms a blocking flap or tongue which at the region of the conductor infeed mouth of the opening or cut-out 24 of the clamping body 25 extends downwardly, i.e. away from the contact element 23. The electrical conductors which are to be fixedly clamped are introduced through the recess 16 into the opening 24 of the clamping body 25, and specifically, between the contact element 23 and the contact spring 30, whereafter, by means of the clamping screw 26 the clamping body 25 is moved upwardly until the conductors are fixedly clamped.

Figure 6:
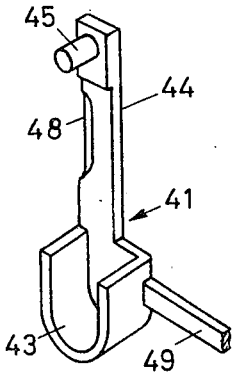
FIG. 6 is a perspective view on an enlarged scale of a single insert element of the terminal shown in FIGS. 1 to 5.
Figure 5:
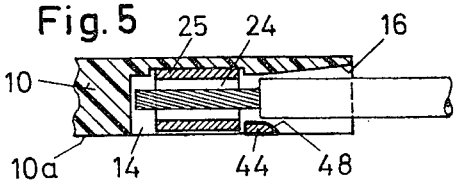
FIG. 5 is a partial longitudinal sectional view along the line V—V of FIG. 4, there also being illustrated a fixedly clamped electrical conductor.

The previously described construction of terminal is known for quite some time. The constructional features which are novel and constitute subject matter of the present invention are the following:

Operatively associated with each of the clamping devices 21 and 22 in an insert element 41 and 42 respectively. These insert elements 41 and 42 are the mirror-image of one another, but otherwise are correspondingly constructed. They consist of a suitable electrically insulating plastic and each possess a pocket-like lower portion 43 and strip-shaped, upwardly extending projection or extension 44 having an anchoring plug or pin 45, as particularly well shown in FIG. 6. In the assembled condition of the insert elements 41 and 42 the pocket-like lower portion 43 is located in each instance in a suitable depression of the recess 14, so that the end portion 32 of the contact spring 30 serving as the blocking flap can extend into the internal space of the lower portion 43 when, for the purpose of loosening the relevant clamping device 21 or 22 respectively, the clamping body 25 is moved downwardly by means of the clamping screw 26, as shown at the right-hand portion of FIG. 1 and in FIGS. 3 and 4. The projection 44 extends along the open side 10*a* of the insulating housing 10 past the funnel-shaped recess 16 towards the clamping screw 26 and forms a boundary or wall of the conductor infeed mouth of the opening or cut-out 24 of the clamping body 25. The anchoring pin 45 engages with a suitable bore of the housing 10, whereas the lower portion 43 is non-displaceably secured by the wall of the recess 14 and by projections 46 and 47 provided in such recess. Each of the insert elements 41 and 42 is introduced from the open side 10*a* of the housing 10 to such an extent into such housing that the outer surface of the insert element and the open flat face or side 10*a* of the housing 10 are located in a common plane, as best recognized by referring to FIGS. 2 and 3. The strip-shaped projection 44 of each insert element 41 and 42 respectively, is provided with an inclined or beveled portion 48 (FIGS. 5 and 6) facilitating the insertion of the conductor into the clamping device 21 or 22 respectively.

Both of the insert elements 41 and 42 are connected with one another into a structural unit by means of a connection web or strut 49 (FIGS. 1, 4 and 6), consisting of a single piece of material or integral component. Also the connection web 49 is introduced into the flat side 10*a* of the housing 10 to such an extent that the outer surface of the connection web 49 and the flat side 10*a* are located in a common plane.

The advantages of the described terminal constructed according to the invention are essentially the following:

Due to the pocket-like lower portion 43 of each insert element 41 and 42 respectively, there are considerably enlarged the air- and leakage paths between the end portion 32 of the contact spring 30 serving as the blocking flap and metal parts located externally of the terminal, such as in particular the support rail carrying the terminal. Consequently, there is provided increased insulation resistance of the terminal. This is then particularly noticeable when the relevant clamping device 21 or 22 respectively, is completely loosened, that is to say, its clamping body 25 is moved completely downwardly, and the blocking flap 32 assumes its lowest position. The projection 44 provides the advantage of easier introduction of the conductors or leads, because the inclined portion 48 guides the leading ends of the conductors towards the mouth of the cut-out or opening 24 of the clamping body 25 like as does the opposite side of the wall of the funnel-shaped recess 16. Additionally, the projection 44, owing to the anchoring of its upper end portion by means of the pin 45 and owing to the non-displaceable seating of the pocket-like lower portion 43 in the housing recess 44, provides for a very advantageous reinforcement of the insulating housing 10, so that there is effectively prevented the danger of any disturbing bending or deformation of the housing 10 towards its closed flat side or face 10*e*. The insert elements 41 and 42 additionally secure against dropping-out the metal parts 23, 25, 30 of the terminal which has been inserted into the recesses 14 open at one side. What is of further advantage with the construction of terminal of this development is the fact that both insert elements 41 and 42 are pressed in an extremely simple manner against the insulating housing 10 and by being locked thereat are connected therewith, so that no tools are needed for this assembly operation. Also of advantage is the fact that the two insert elements 41 and 42 are united into a single structural unit by the connection web 49, with the result that both of the insert elements can be simultaneously applied at the insulating housing 10. This is simpler than the heretofore conventional technique of pushing insulating hose pieces or sections onto the blocking flaps 32, which additionally provided a poorer insulation resistance of the terminal than the described insert elements 41 and 42. Finally, there should be also mentioned as a still further advantage of the invention that the width of the terminal is not enlarged by the insert elements 41 and 42 due to their recessed arrangement in the insulating housing 10.

With not particularly illustrated constructional embodiments of terminals which possess only a single clamping device 21 or 22 of the described type, there of course is only necessary a single insert element 41 or 42, and there is dispensed with the connection web 49. Yet, the above-discussed advantages remain completely intact.

While there is shown and described present preferred embodiments of the invention, it is to be distinctly understood that the invention is not limited thereto, but may be otherwise variously embodied and practiced within the scope of the following claims. Accordingly, I claim:

1. An electrical terminal comprising a substantially flat insulating housing provided with recesses open towards one of its flat sides, at least one clamping device arranged in the housing for fixedly clamping at least one electrical conductor, said clamping device comprising a stationary contact element and a clamping body provided with an opening for the reception of said at least one conductor, a clamping screw, the clamping body being movable by means of the clamping screw in a direction substantially perpendicular to the contact element, the contact element extending into the opening of the clamping body, said opening including a conductor infeed mouth, a blocking flap extending in a direction away from the contact element provided at the conductor infeed mouth of the opening of the clamping body for preventing the mistaken introduction of a conductor externally of the clamping body into the insulating housing, at least one insert element formed of insulating material arranged at the open flat side of the insulating housing, said insert element forming a pocket for the reception of the blocking flap.

2. The terminal as defined in claim 1, wherein the insert element comprises a substantially strip-shaped projection extending in the direction of the clamping screw, said projection forming along the open side of the insulating housing a boundary of the conductor infeed mouth of the opening of the clamping body.

3. The terminal as defined in claim 2, wherein a part of the insert element forms said pocket and said part and an end portion of the projection which faces away from such part are each anchored in the insulating housing.

4. The terminal as defined in claim 1, wherein the insert element is mounted in a recessed fashion in the insulating housing in such a manner that its outer surface and the open flat side of the housing are substantially located in a common plate.

5. The terminal as defined in claim 4, wherein the insert element is lockingly engaged in the insulating housing.

6. The terminal as defined in claim 1, wherein two of said clamping devices of similar construction are arranged in mirror-image relationship to one another in the insulating housing, said contact element being common to both said clamping devices, one such insert element is respectively provided for each of the clamping devices, a connection web for mechanically connecting both insert elements with one another into a structural unit.

7. The terminal as defined in claim 6, wherein the two insert elements and the connection web consist of a single piece of material.

8. The terminal as defined in claim 6, wherein the two insert elements and the connection web are arranged recessed in the insulating housing in such a manner that the outer surface of the insert elements and the connection web and the open flat side of the housing are substantially located in a common plane.

9. The terminal as defined in claim 8, wherein the structural unit composed of the two insert elements and the connection web are lockingly engaged in the insulating housing.

10. An electrical terminal comprising a housing, at least one clamping device supported in the housing for fixedly clamping at least one electrical conductor, said clamping device comprising a stationary contact element and a clamping body provided with an opening for the reception of said at least one conductor, the contact element extending into the opening of the clamping body, a blocking flap provided at the opening of the clamping body for preventing the mistaken introduction of a conductor externally of the clamping body into the housing, at least one insert element arranged at the insulating housing, said insert element forming a pocket for the reception of the blocking flap.

* * * * *